US012760929B2

(12) United States Patent
Passafonti et al.

(10) Patent No.: US 12,760,929 B2
(45) Date of Patent: Oct. 13, 2026

(54) PIVOTABLE ROOF CURB SYSTEM

(71) Applicant: AC Pro Inc., Fontana, CA (US)

(72) Inventors: Daniel Passafonti, Huntington Beach, CA (US); David Dean Mc Comb, Highland, CA (US)

(73) Assignee: AC Pro Inc., Fontana, CA (US)

( * ) Notice: Subject to any disclaimer, the term of this patent is extended or adjusted under 35 U.S.C. 154(b) by 208 days.

(21) Appl. No.: 18/538,499

(22) Filed: Dec. 13, 2023

(65) Prior Publication Data

US 2025/0198652 A1 Jun. 19, 2025

(51) Int. Cl.
*F24F 13/32* (2006.01)

(52) U.S. Cl.
CPC ..... *F24F 13/32* (2013.01); *F24F 2221/16* (2013.01)

(58) Field of Classification Search
CPC ..... F24F 13/32; F24F 2221/00; F24F 2221/16
See application file for complete search history.

(56) References Cited

U.S. PATENT DOCUMENTS 4,483,155 A 11/1984 Stiles
4,759,270 A * 7/1988 Lindeen ..... B60H 1/262 454/94
4,917,345 A * 4/1990 Czech ..... F16M 7/00 248/237
5,244,264 A 9/1993 Woodard
5,454,538 A 10/1995 Merideth
5,687,514 A 11/1997 Gillispie
5,791,092 A * 8/1998 Strieter ..... F24F 13/32 52/27
D431,174 S 9/2000 Merideth
6,343,439 B1 2/2002 Rutledge
7,540,123 B1 6/2009 Semmes
7,950,620 B2 5/2011 Knight
8,640,477 B1 2/2014 Merideth
8,960,620 B1 2/2015 Merideth
9,157,572 B1 10/2015 Merideth
9,217,581 B1 12/2015 Merideth
11,027,595 B2 * 6/2021 Smith ..... B60H 1/262
11,047,133 B1 * 6/2021 Barton ..... E04D 3/366
11,788,744 B2 * 10/2023 Stocker ..... F16L 37/244 454/338
2006/0070316 A1 4/2006 Lewis et al.
2008/0022615 A1 * 1/2008 Fox ..... F24F 13/222 52/302.1
2011/0073017 A1 * 3/2011 Wilson, Jr. ..... F16M 5/00 248/346.03

(Continued)

*Primary Examiner* — Chi Q Nguyen
(74) *Attorney, Agent, or Firm* — Olav M. Underdal; IDP Patent Services

(57) ABSTRACT

An adjustable roof curb system includes: a roof-mountable appliance; an adjustable roof curb device, including a top curb component with left and right pivoting pins and a base curb component; and locking screws; such that a longitudinal inclination angle is adjustable by pivoting of the top curb component relative to the base curb component; such that the adjustable roof curb device is adjustable for mounting on a pitched surface of a roof, such that the longitudinal inclination angle is equal to a roof pitch angle of the roof, such that the top surface of the top curb component is adjusted to be level; such that the roof-mountable appliance is level mountable on the top curb component.

21 Claims, 12 Drawing Sheets

Adjustable Roof Curb System

(56) References Cited

U.S. PATENT DOCUMENTS

| | | | | |
|---|---|---|---|---|
| 2013/0341485 | A1* | 12/2013 | Wilson, Jr. | F24F 13/32 248/670 |
| 2016/0252263 | A1* | 9/2016 | Chwala | F24F 7/02 454/354 |
| 2016/0312465 | A1 | 10/2016 | Azar | |
| 2018/0209672 | A1* | 7/2018 | Chwala | F24F 7/025 |
| 2025/0075921 | A1* | 3/2025 | Fervoy | F24F 13/20 |

* cited by examiner

Adjustable Roof Curb System

PIVOTABLE ROOF CURB SYSTEM

CROSS-REFERENCE TO RELATED APPLICATIONS

N/A.

FIELD OF THE INVENTION

The present invention relates generally to the field of roof curbs and more particularly to methods and systems for pivotable roof curbs for enabling installation of roof mounted air conditioning systems on roofs with varying inclination angles.

BACKGROUND OF THE INVENTION

When an air conditioning unit is placed on a roof, it needs to have a level base that is first attached to the roof. This base is commonly referred to as a roof curb in the industry. Such roof curbs come in a number of styles, some of which are designed to accommodate a range of different roof angles.

However, a shared problem of these designs is that it is difficult to get the roof curb positioned to the correct angle and height. The uphill end of the curb needs to drop at the same time that the downhill end is raised. If this doesn't happen accurately, the roof curb tends to get stuck where it is and makes it difficult to get it positioned properly. Furthermore, this process is difficult, if not impossible, to complete without two persons holding the roof curb.

As such, considering the foregoing, it may be appreciated that there continues to be a need for novel and improved devices and methods for pivotable roof curb systems.

SUMMARY OF THE INVENTION

The foregoing needs are met, to a great extent, by the present invention, wherein in aspects of this invention, enhancements are provided to the existing model of pivotable roof curb systems.

In an aspect, an adjustable roof curb system can include:

a) a roof-mountable appliance; and b) an adjustable roof curb device, which can include:

i. a top curb component; and ii. a base curb component;

wherein the top curb component is configured to slide over the base curb component, such that a longitudinal inclination angle, between a top surface of the top curb component and a bottom surface of the base curb component, is adjustable by pivoting of the top curb component relative to the base curb component around a pivot point;

such that the adjustable roof curb device is adjustable for mounting on a pitched surface of roof, such that the longitudinal inclination angle is equal to a roof pitch angle of the roof, such that the top surface of the top curb component is adjusted to be level;

such that when the top curb component has been adjusted to be level, the top curb component can be secured in position by locking screws screwed through sides of the top curb component and the base curb component;

whereby the roof-mountable appliance can be mounted level on the top curb component.

In a related aspect, the top curb component can further include:

a) a top curb body;

b) a right pivot pin, which is mounted on an inner right surface of a front upper part of a right side of the top curb body; and c) a left pivot pin, which is mounted on an inner left surface of a front upper part of a left side of the top curb body;

such that the right pivot pin and the left pivot pin can be configured to contact right and left sides of the base curb component, respectively, during adjustment of the longitudinal inclination angle, such that the right pivot pin and the left pivot pin can function as pivot points during adjustment of the longitudinal inclination angle.

In a further related aspect, the right pivot pin and the left pivot pin can be configured to rest on right and left upper edges of the base curb component, respectively, during adjustment of the longitudinal inclination angle.

In another related aspect, the adjustable roof curb device can be configured such that:

a) the right side of the base curb component can include a right pivot aperture; and b) the left side of the base curb component can include a left pivot aperture;

such that the right pivot pin protrudes through the right pivot aperture and the left pivot pin protrudes through the left pivot aperture.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
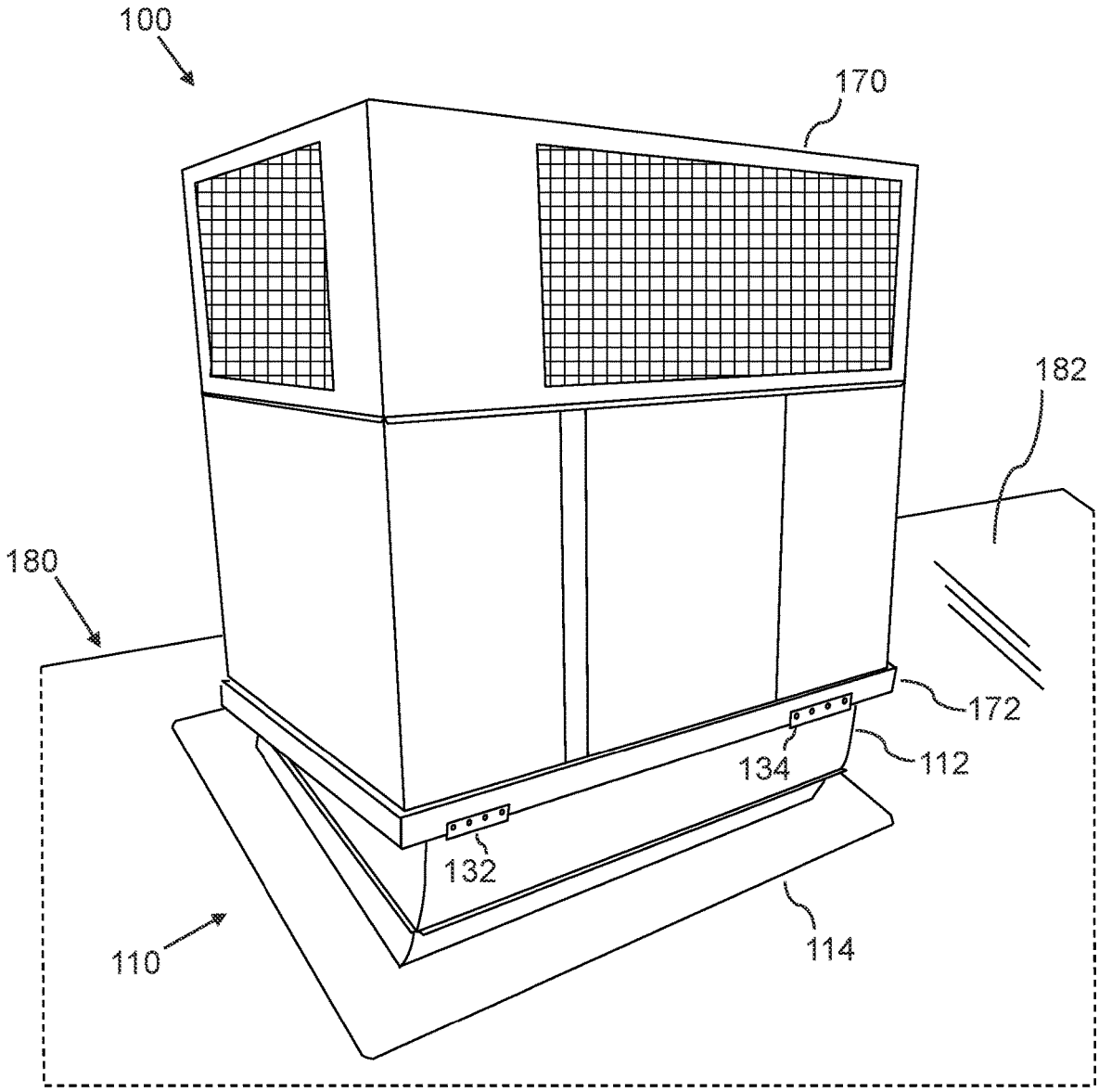
FIG. 1 is a perspective view of an adjustable roof curb system mounted with an air-conditioning system on a roof, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of an adjustable roof curb system 100, including an adjustable roof curb device 110, with reference to FIG. 1, in such manner that like reference numerals refer to like components throughout; a convention that we shall employ for the remainder of this specification.

Figure 2A:
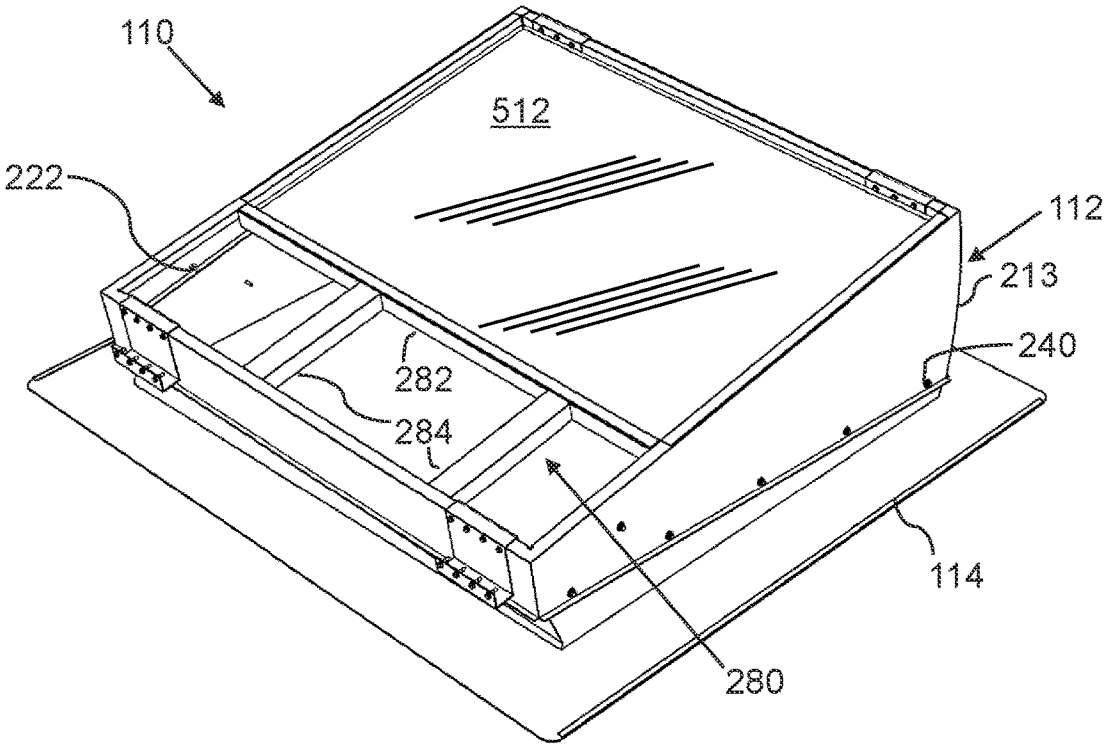
FIG. 2A is a top front left perspective view of an adjustable roof curb device, according to an embodiment of the invention.
Figure 2B:
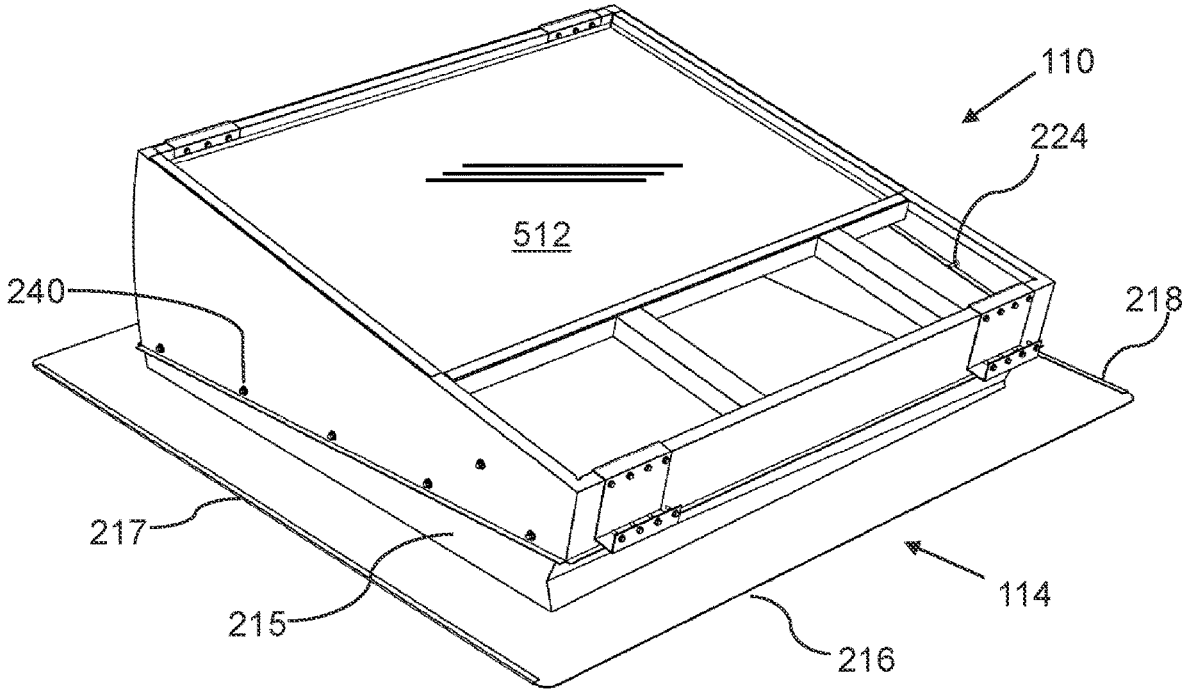
FIG. 2B is a top front right perspective view of an adjustable roof curb device, according to an embodiment of the invention.

In an embodiment, as shown in FIGS. 1 and 2A-2B, an adjustable roof curb system 100 can include:

a) a roof-mountable appliance 170, which for example can be an air-conditioning unit as shown; and b) an adjustable roof curb device 110, which can include:

i. a top curb component 112; and ii. a base curb component 114;

wherein the top curb component 112 is configured to slide over the base curb component 114, such that a longitudinal inclination angle 416, between a top surface 413 of the top curb component 112 and a bottom surface 415 of the base curb component 114, is adjustable by pivoting 422, 424, 426 of the top curb component 112 relative to the base curb component 114 around a pivot point/lateral pivot axis 428, which can be defined by the left and right pivot pins 222, 224;

such that the adjustable roof curb device 110 is adjustable for mounting on a pitched surface 182 of roof 180, such that the longitudinal inclination angle 416 is equal to a roof pitch angle 418 of the roof 180, such that the top surface 413 of the top curb component 112 is adjusted to be level;

such that when the top curb component 112 has been adjusted to be level, the top curb component 112 can be secured in position by locking screws 240 screwed through sides of the top curb component 112 and the base curb component 114;

whereby the roof-mountable appliance 170 can be mounted level (i.e., is level mountable) on the top curb component 112.

In a related embodiment, as shown in FIGS. 2A-2B, 4A-4D, and 5A-5B, the top curb component 112 can further include:

a) a top curb body 213, which can include front, rear, left, and right sides, such that the top curb body 213 defines an interior with top and bottom openings;

b) a right pivot pin 222, which is mounted on an inner right surface of a front upper part of a right side of the top curb body 213; and c) a left pivot pin 224, which is mounted on an inner left surface of a front upper part of a left side of the top curb body 213;

such that the right pivot pin 222 and the left pivot pin 224 can be configured to contact right and left sides of the base curb component 114, respectively, during adjustment of the longitudinal inclination angle 416, such that the right pivot pin 222 and the left pivot pin 224 can function as pivot points during adjustment of the longitudinal inclination angle 416.

In a further related embodiment, the right pivot pin and the left pivot pin can be configured to rest on right and left upper edges of the base curb component 114, respectively, during adjustment of the longitudinal inclination angle 416.

Figure 4A:
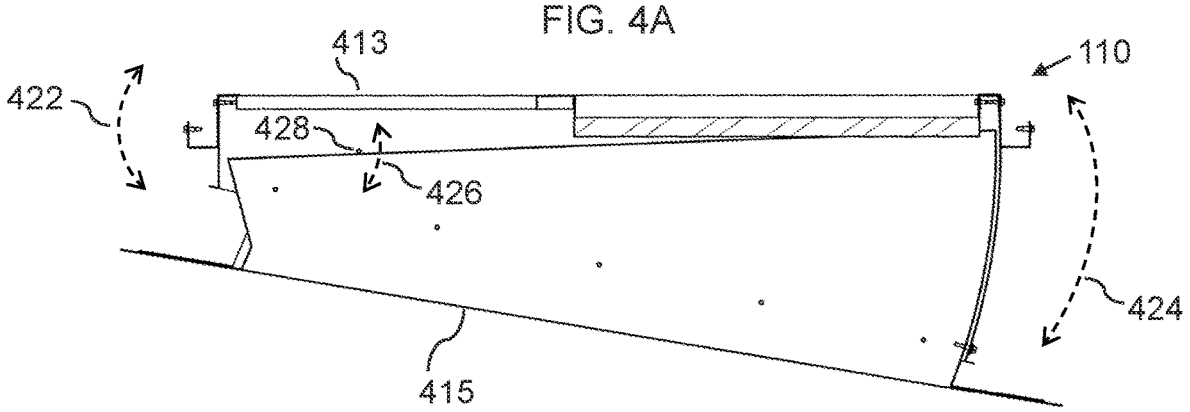
FIG. 4A is a right side sectional view of an adjustable roof curb device, which is level mounted on a roof with a first roof inclination, according to an embodiment of the invention.
Figure 4B:
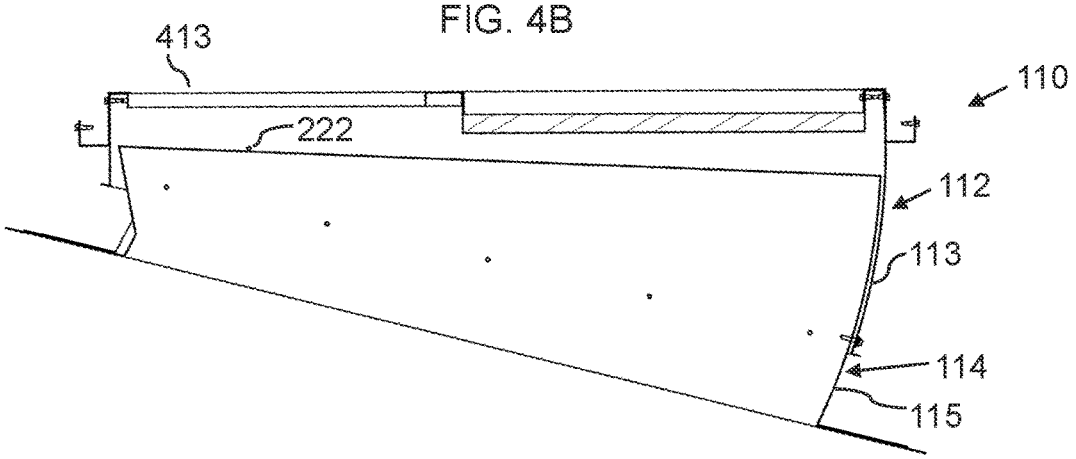
FIG. 4B is a right side sectional view of an adjustable roof curb system, which is level mounted on a roof with a second roof inclination, according to an embodiment of the invention.
Figure 4C:
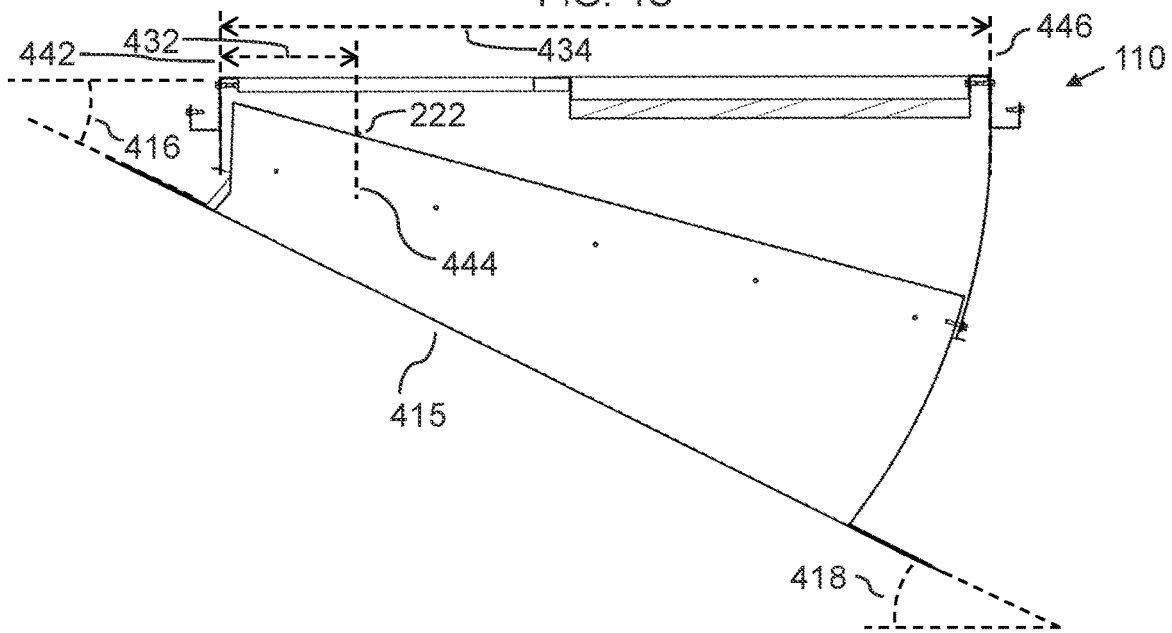
FIG. 4C is a right side sectional view of an adjustable roof curb system, which is level mounted on a roof with a third roof inclination, according to an embodiment of the invention.

In a related embodiment, FIGS. 4A, 4B, and 4C show three respective configurations of the adjustable roof curb device 110, configured for different roof angles, corresponding to 2-12, 4-12, and 6-12 pitch angles, respectively, with the right and left pivot pin 222, 224 resting on right and left upper edges of the base curb component 114, respectively.

Figure 2C:
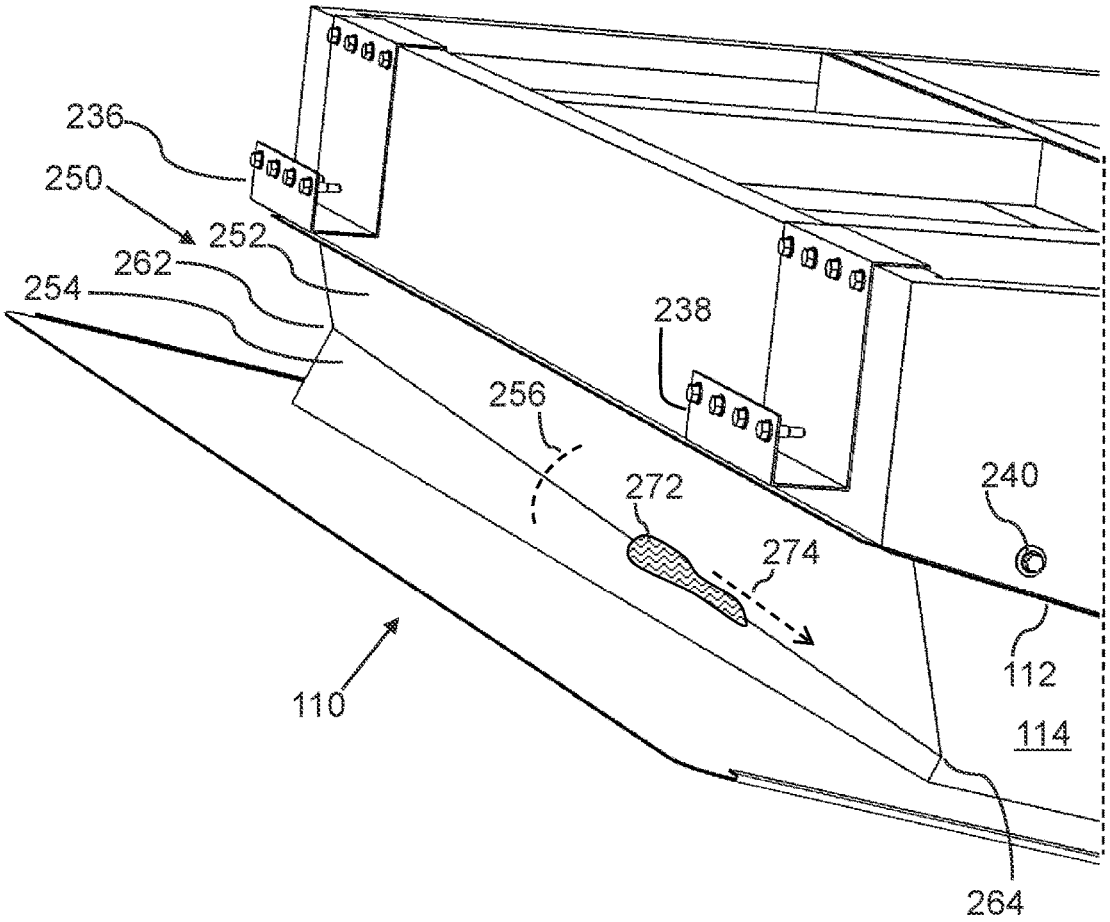
FIG. 2C is a front left perspective view of a front portion of an adjustable roof curb device, according to an embodiment of the invention.
Figure 2D:
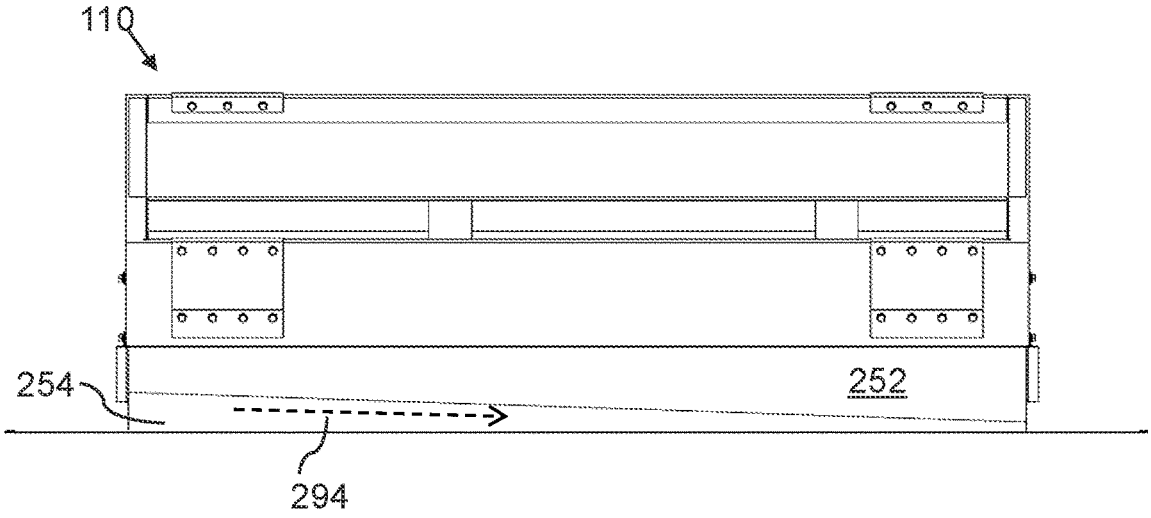
FIG. 2D is a front view of an adjustable roof curb device, according to an embodiment of the invention.
Figure 2E:
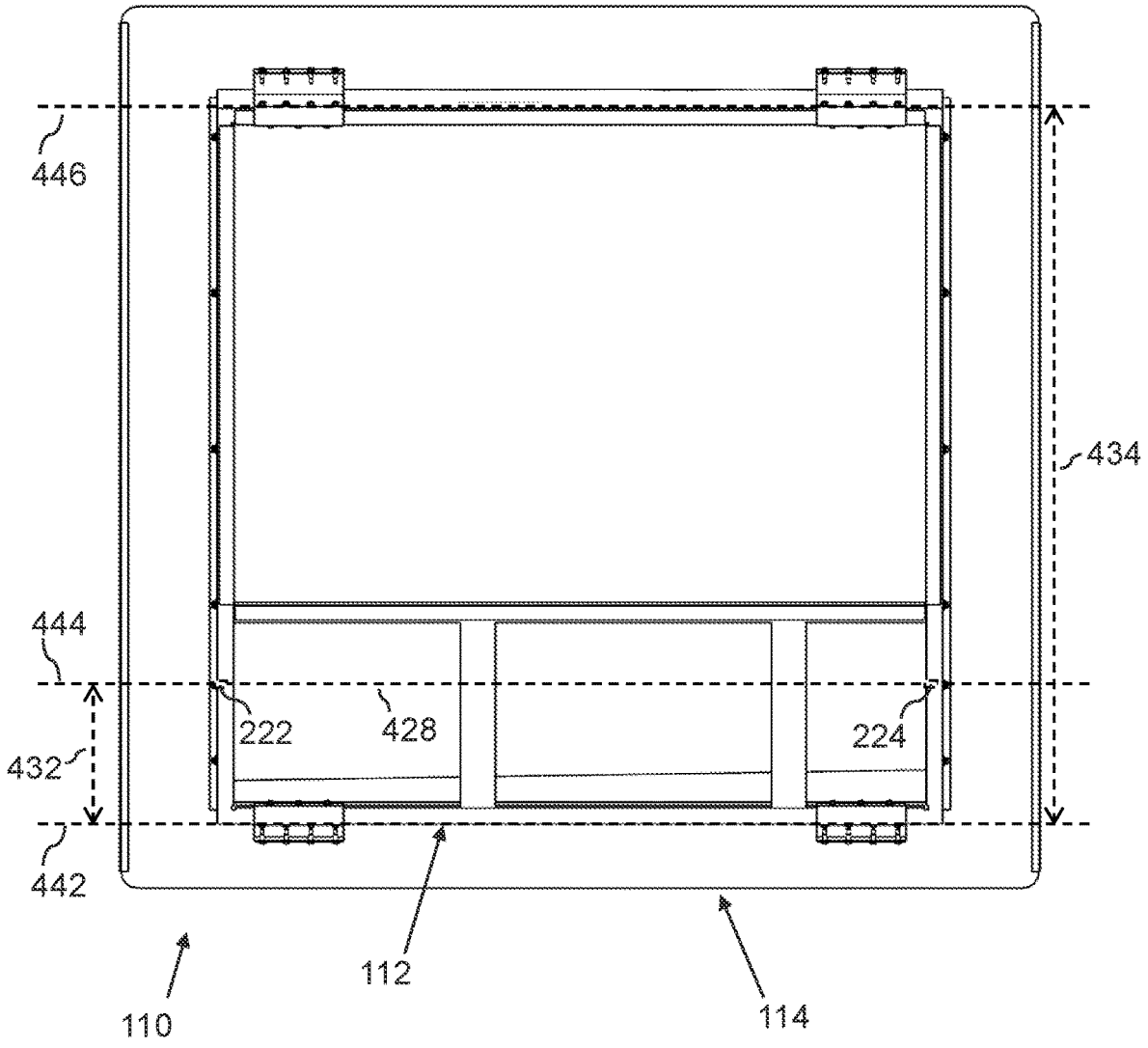
FIG. 2E is a front view of an adjustable roof curb device, according to an embodiment of the invention.
Figure 3A:
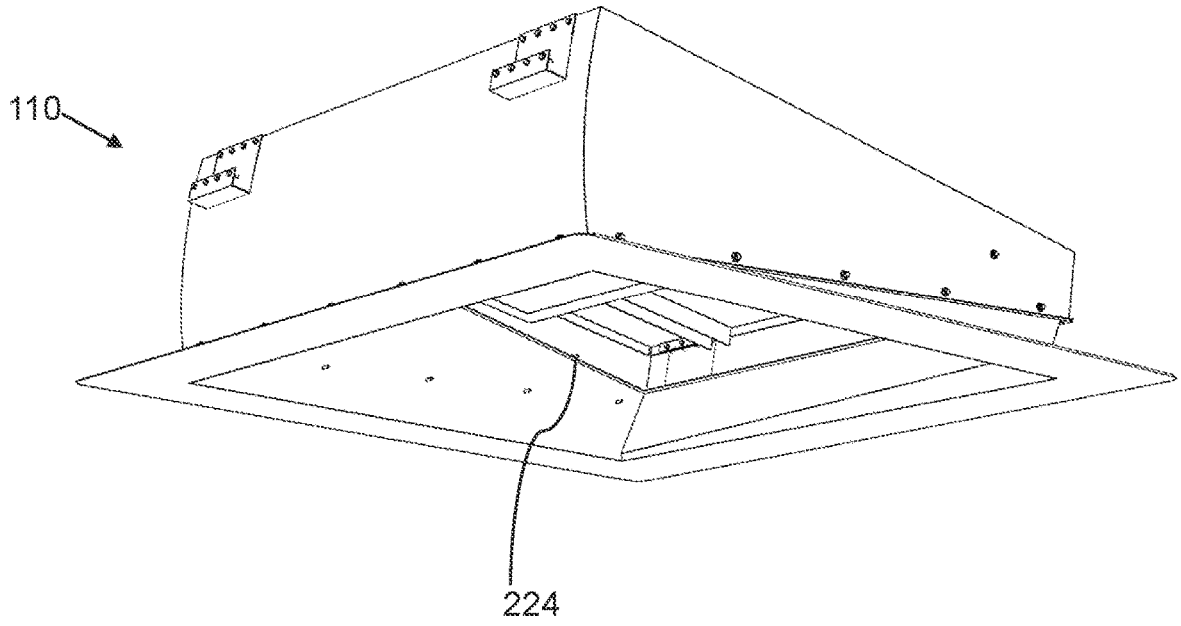
FIG. 3A is a bottom rear right perspective view of an adjustable roof curb device, according to an embodiment of the invention.
Figure 3B:
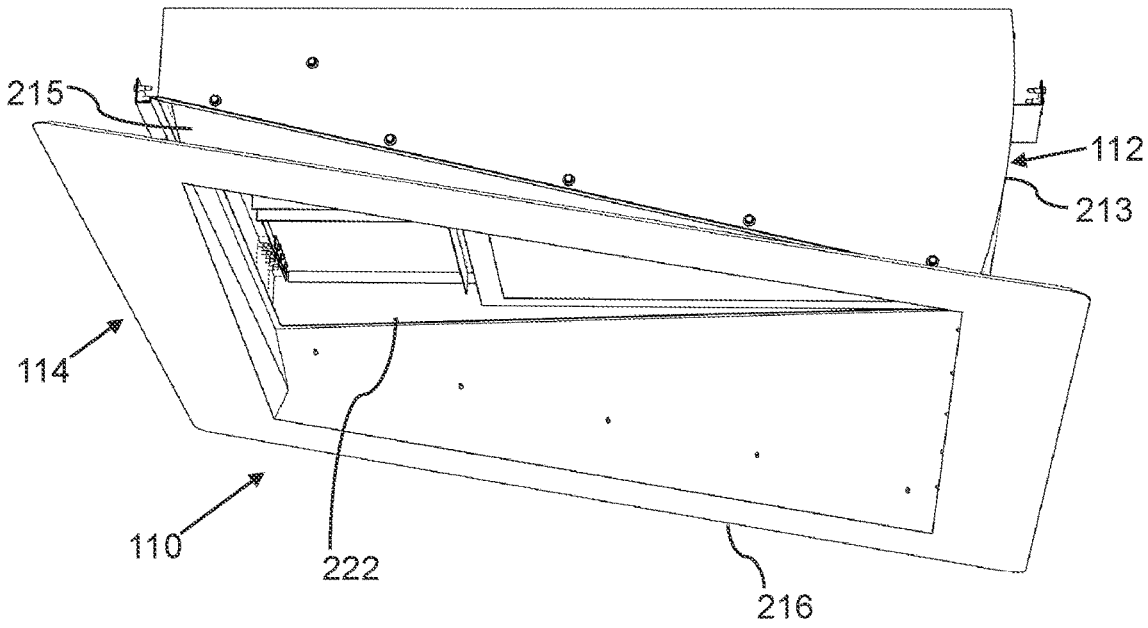
FIG. 3B is a bottom rear left perspective view of an adjustable roof curb device, according to an embodiment of the invention.

In a further related embodiment, as shown in FIGS. 2E and 4C, the lateral pivot axis 428 can be positioned in a front portion of the top curb component 112, such that a front longitudinal top plan length 432 of the top curb component 112, between a front upper edge 442 of the top curb component 112 and a top plan longitudinal position 444 of the lateral pivot axis 428 between the left and right pivot pins 222, 224 can be in a range of 10-30 percent of the total longitudinal top plan length 434 of the top curb component 112, between the front upper edge 442 of the top curb component 112 and a rear upper edge 446 of the top curb component 112. The front mounted position ensures vertical pivotal movement in both front and rear of the top curb component 112, such that use of materials are minimized, while keeping the roof curb height to a minimum, which aids in ensuring structural strength and providing a desirable aesthetic appearance when mounted on the roof 180.

In yet further related embodiments, a relative ratio of the front longitudinal top plan length 432 to the total longitudinal top plan length 434 of the top curb component 112 can be in range of 17-19, 15-21, 12-24, or (as described above) 10-30 percent. Note that in FIGS. 2E and 4C, the front longitudinal top plan length 432 and the total longitudinal top plan length 434 are substantially defined by the top surface 413 of the top curb component 112, but in general should be understood relative to the longitudinal extension of the top curb component 112 as measured in a top plan view with the top surface 413 of the top curb component 112 in a level position, wherein the longitudinal extension of the top curb component 112 can include front longitudinally protruding portions of a top front side 542 of the top curb component 112 and rear longitudinally protruding portions of a front side 542 of the top curb component, as measured in a top plan view with the top surface 413 of the top curb component 112 in a level position 112.

Figure 6A:
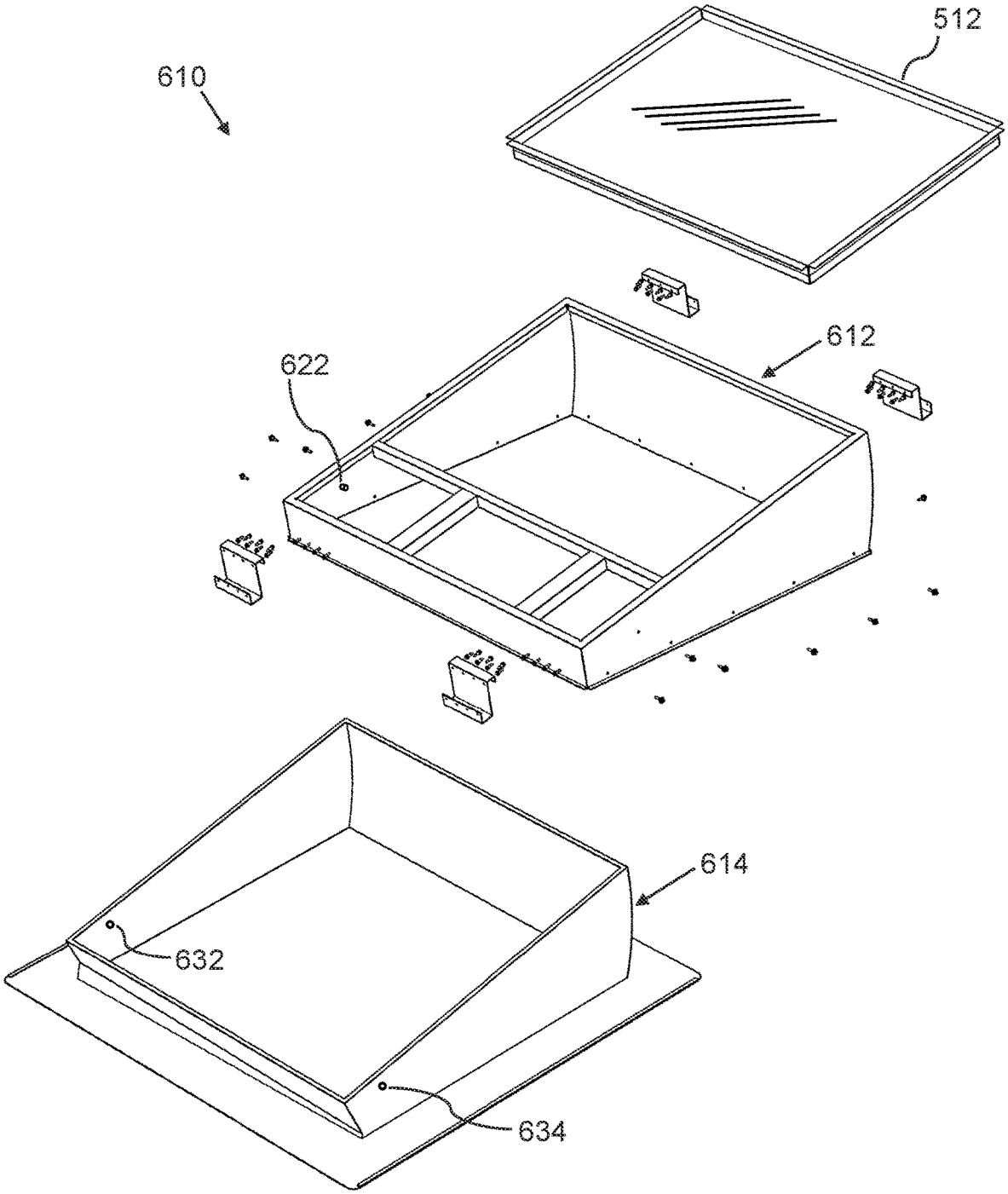
FIG. 6A is an exploded top perspective view of an adjustable roof curb system, according to an embodiment of the invention.
Figure 6B:
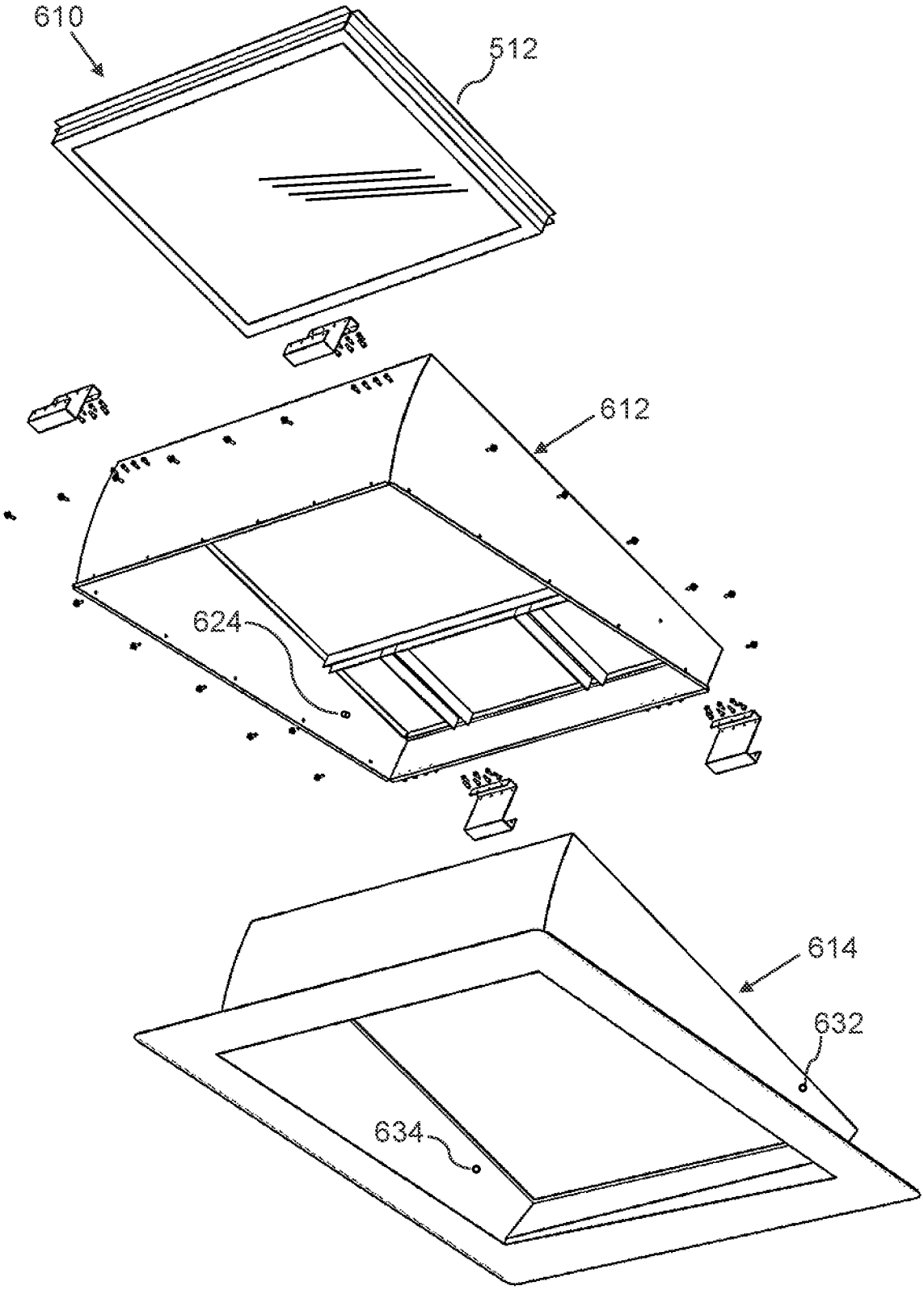
FIG. 6B is an exploded bottom perspective view of an adjustable roof curb system, according to an embodiment of the invention.

In another related embodiment, as shown in FIGS. 6A and 6B, the adjustable roof curb device 110 can be configured such that:

a) the right side of the base curb component 614 can include a right pivot aperture 632; and b) the left side of the base curb component 614 can include a left pivot aperture 634;

such that the right pivot pin 622 (of the top curb component 612) protrudes through the right pivot aperture 632 and the left pivot pin 624 protrudes through the left pivot aperture 634.

In a related embodiment, a top front angle 532 between a top front side 542 and a top upper edge 543 of the top curb component 112 can be larger than a bottom front angle 534 between a bottom front side 544 and a bottom upper edge 545 of the base curb component 114, to enable pivoting of the top curb component 112 relative to the base curb component 114 while ensuring water sealing of the adjustable roof curb device 110.

In a further related embodiment, the top front angle 532 of the top curb component 112 can be 90 degrees and the bottom front angle 534 of the base curb component 114 can be in a range of 65 degrees to 85 degrees.

In a related embodiment, each of a top rear side 536 of the top curb component 112 and a bottom rear side 538 of the base curb component 114 can be shaped as a laterally-elongated cylinder segment, to enable pivoting of the top curb component 112 relative to the base curb component 114.

Figure 4D:
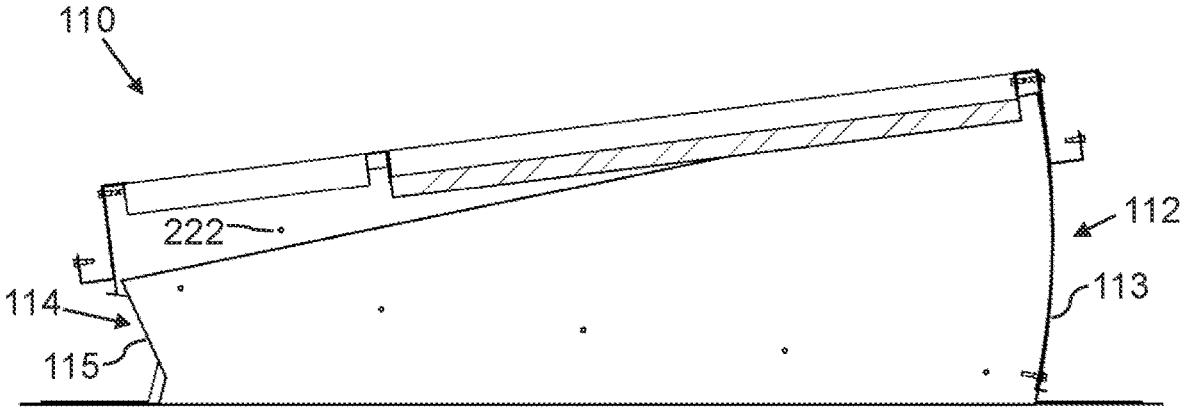
FIG. 4D is a right side sectional view of an adjustable roof curb system, which is level mounted on a roof with pivot points in a lifted position, according to an embodiment of the invention.
Figure 5A:
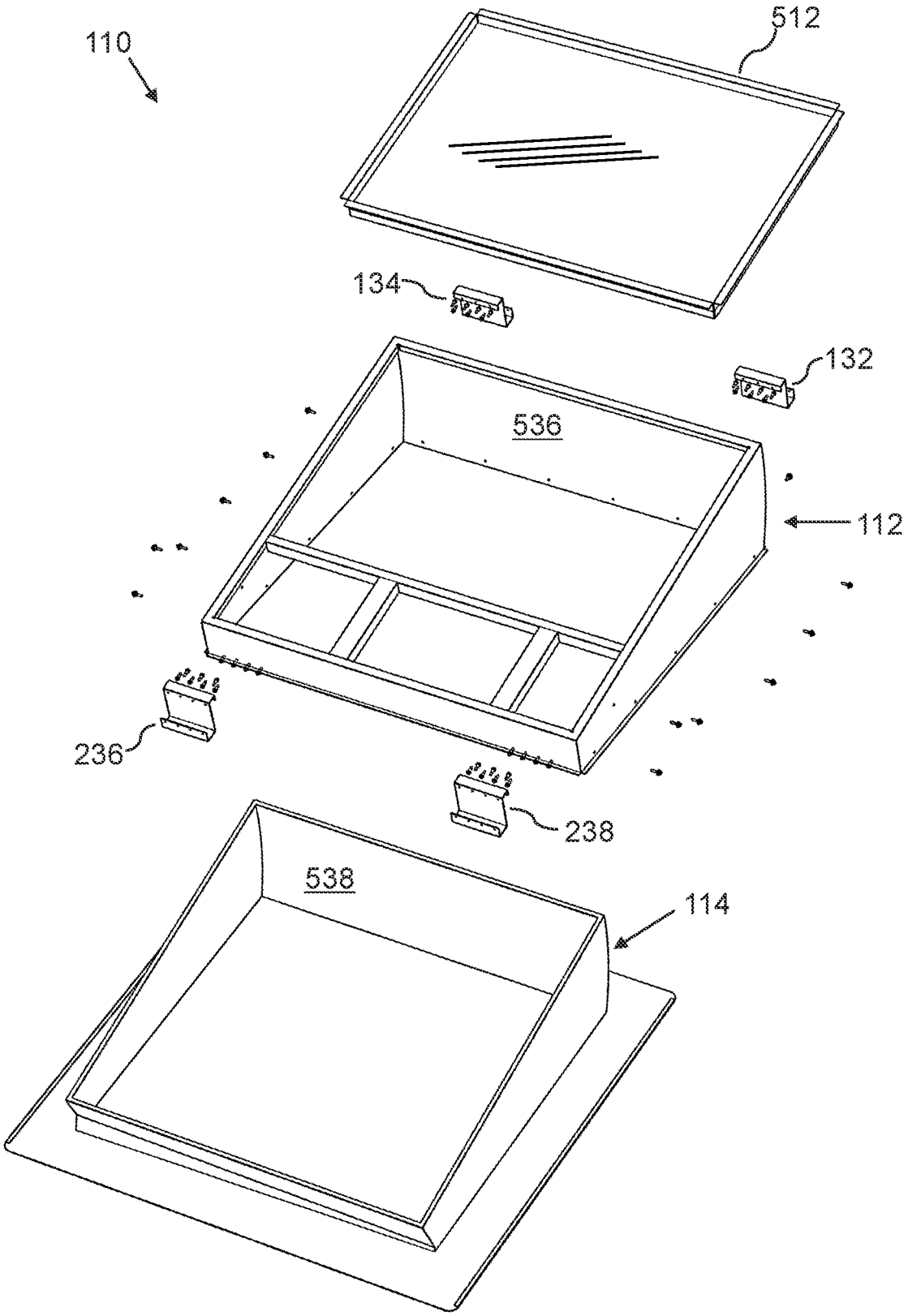
FIG. 5A is an exploded top perspective view of an adjustable roof curb system, according to an embodiment of the invention.
Figure 5B:
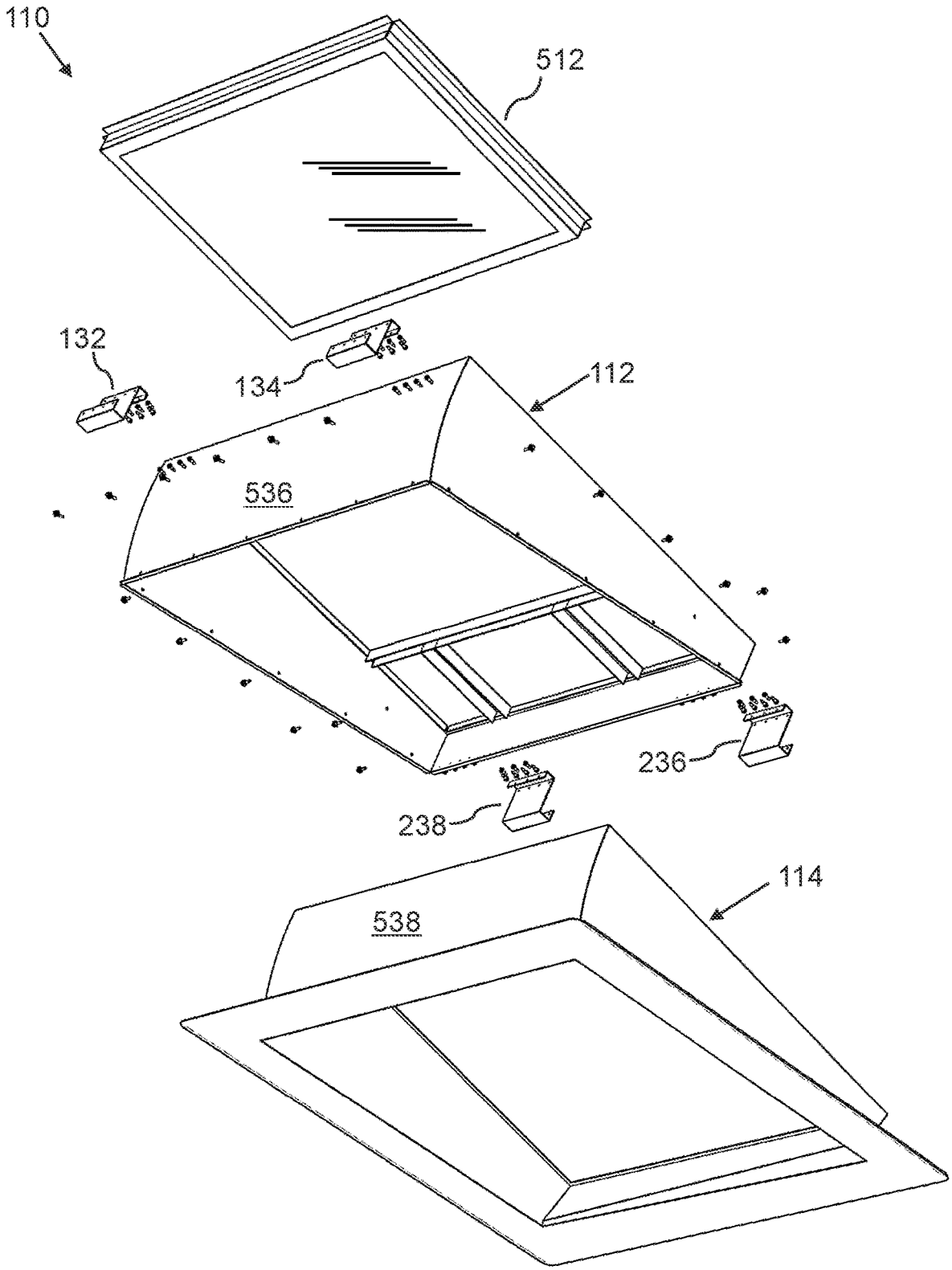
FIG. 5B is an exploded bottom perspective view of an adjustable roof curb system, according to an embodiment of the invention.
Figure 5C:
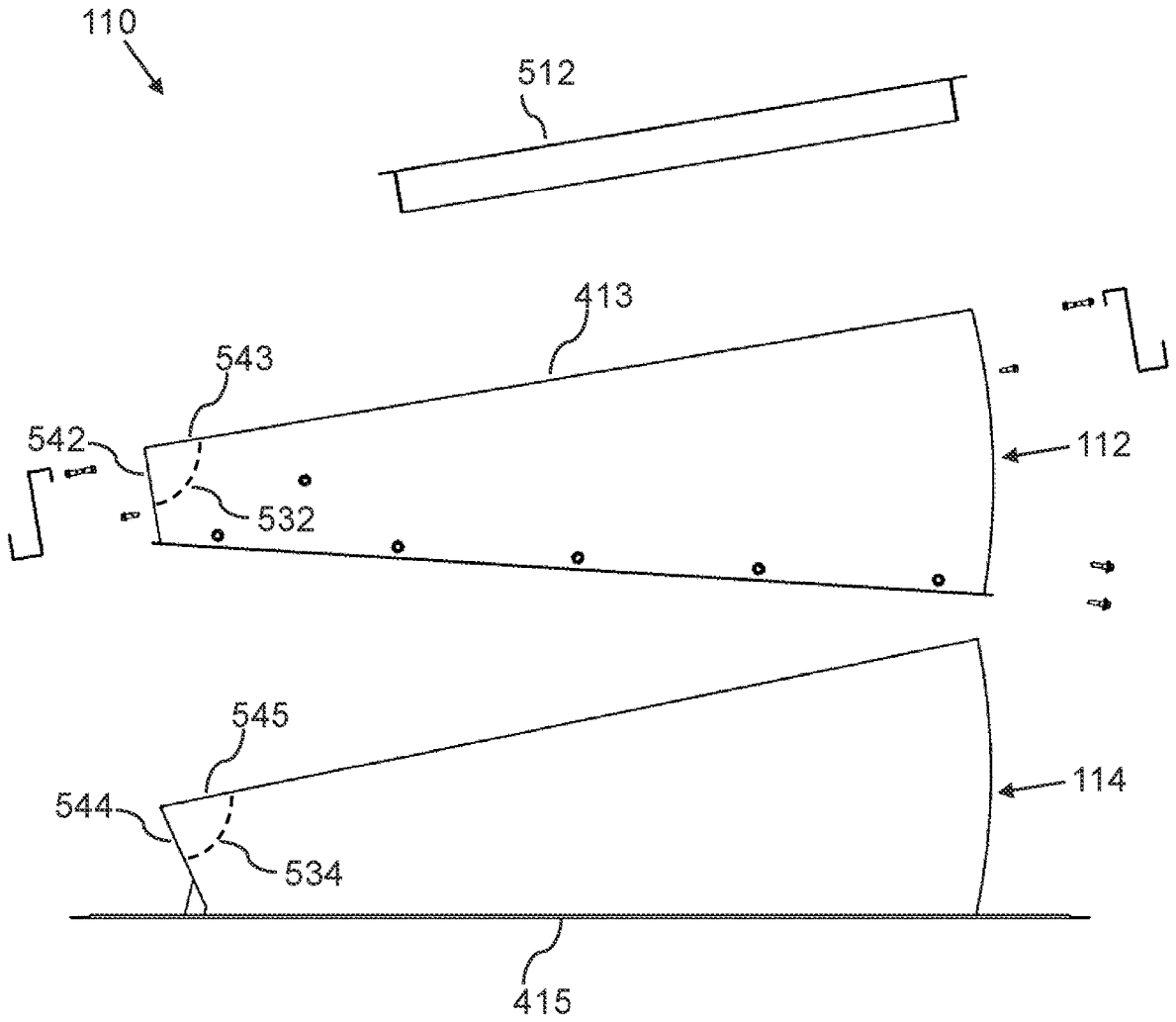
FIG. 5C is an exploded side view of an adjustable roof curb system, according to an embodiment of the invention.

FIG. 4D shows a configuration wherein the right and left pivot pin 222, 224 are "floating", i.e. positioned above the right and left upper edges of the base curb component 114, respectively. Such as positioning of the pivot pin above the base can extend the adjustment range of the longitudinal inclination angle 416 of the curb device 110 slightly, but also enables an installer to lift an end for leveling of the curb device 110, particularly if the roof isn't completely flat or if the installation isn't perfectly aligned to the slope of the roof.

In a further related embodiment, as shown in FIGS. 2A-2B and 5A-5B, the top curb component 112 can further include:

a) a mounting bar assembly 280, which can be mounted in a front portion of a top opening of the top curb body 213, wherein the mounting bar assembly 280 can include:

i. a lateral long bar 282; and ii. and at least one longitudinal short bar 284;

wherein the front of the top opening of the top curb body 213 can accommodate duct tubes for supply air and return air from and to the roof-mountable appliance 170; and b) a sound insulation panel 512, which can be configured to close a rear portion of the top opening of the base curb body 215, wherein the rear of the top opening can be positioned to a rear of the lateral long bar 282.

In a related embodiment, as shown in FIG. 2C, a front side of the base curb component can be configured as a lateral downward-angled V-shaped canal 250, which can include:

a) an upper front portion 252, which is laterally elongated; and b) a lower front portion 254, which is laterally elongated;

wherein the upper front portion 252 is connected to the lower front portion 254 along a lateral direction 294, such that a canal angle 256 between the upper front portion 252 and the lower front portion 254 is less than 180 degrees; and such that a first end 262 of the lateral downward-angled V-shaped canal 250 is positioned higher than a second end 264 of the lateral downward-angled V-shaped canal 250, when the adjustable roof curb device 110 is positioned level on roof, such that the lateral downward-angled V-shaped canal 250 is configured to guide a flow 274 of rainwater 272 from the first end 262 to the second end 264.

In a further related embodiment, as shown in FIGS. 2C and 2D, the upper front portion 252 can be configured to be widening from the first end 262 to the second end 264 and the lower front portion 254 can be configured to be narrowing from the first end 262 to the second end 264, such that the lateral downward-angled V-shaped canal 250 guides the water to exit the lateral downward-angled V-shaped canal 250 closer to a surface 182 of the roof 180.

In a related embodiment, as shown in FIG. 2C, the adjustable roof curb system 100 can further include:

a) at least two first s-brackets 132, 134, such that an inner portion of each of the at least two first s-brackets 132, 134 is configured to hang from an upper edge of a first side (such as rear or right) of the top curb component 112; and b) at least two second s-brackets 236, 238, such that an inner portion of each of the at least two second s-brackets 236, 238 is configured to hang from an upper edge of an opposing second side (such as front or left) of the top curb component 112;

such that a lower portion 172 of the roof-mountable appliance 170 can be mounted on outer portions of the at least two first s-brackets 132, 134 and the at least two second s-brackets 236, 238.

In another related embodiment, as shown in FIGS. 2A-2B, the base curb component 114 can further include:

a) a base curb body 215, which can include front, rear, left, and right sides, such that the base curb body 215 defines an interior with top and bottom openings; and b) a peripheral flange 216, which connected to a lower end of the base curb body 215, such that the peripheral flange 216 extends around a perimeter of the lower end of the base curb body 215, such that the peripheral flange 216 is configured to lie flat against the roof 180 and aid in providing a watertight seal.

In a further related embodiment, right and left sides of the peripheral flange 216 can be bent upwards and back in a u-shape, such that the peripheral flange 216 comprises right and left rain guards 217, 218, which can aid in guiding rainwater downwards and avoid potential leakage of water under the right and left sides of the peripheral flange 216.

Thus, in various related embodiments, an adjustable roof curb device 110 can be configured with a pivot point built into it, such that when the rear/downhill end is raised, the adjustable roof curb device 110 pivots on the pin making the pitch adjustment easy and assuring that the two pieces of the adjustable roof curb device 110 are properly lined up throughout the range of roof angles that the adjustable roof curb device 110 was designed for. This allows the adjustable roof curb device 110 to be designed with a minimal amount of material and makes proper installation of the roof curb much easier. The height of each end of the adjustable roof curb device 110 changes with the pitch. If it doesn't change on both ends, then the range of working angles is reduced and the amount of material needed to make the adjustable roof curb device 110 increases. Both options are undesirable raising cost and reducing functionality.

In related embodiments, this pivot point cab be a pin that is attached to the upper portion of the adjustable roof curb device 110, and rests on the top of the bottom half of the adjustable roof curb device 110. When the pivot is positioned above the base this can slightly extend the angle range of the adjustable roof curb device 110, but the primary purpose is to enable an installer to lift an end to make it level if the roof isn't completely level or if the installation isn't perfectly aligned to the slope of the roof they can adjust the curb so that it is level for the AC unit.

In an alternative design the pivot point can be located so that it is in the bottom half of the curb instead of resting on top of the bottom half, such that the top and bottom components of the adjustable roof curb device 110 are limited to pivot about that point, which can make the top and bottom components easier to rotate, as they cannot move out of alignment with the pivot point, and thereby in some cases make easier to move the adjustable roof curb device 110 into a level position.

Here has thus been described a multitude of embodiments of the adjustable roof curb system 100 and the adjustable roof curb device 110, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. An adjustable roof curb system, comprising:

a) a roof-mountable appliance; and b) an adjustable roof curb device, comprising:

a top curb component; and a base curb component;

wherein the top curb component is configured to slide over the base curb component, such that a longitudinal inclination angle, between a top surface of the top curb component and a bottom surface of the base curb component, is adjustable by pivoting of the top curb component relative to the base curb component;

wherein the top curb component further comprises:

a top curb body;

a right pivot pin mounted on an inner right surface of a front upper part of a right side of the top curb body; and a left pivot pin mounted on an inner right surface of a front upper part of a left side of the top curb body;

such that the right pivot pin and the left pivot pin are configured to contact with a right side and a left side of the base curb component, respectively, to function as pivot points during adjustment of the longitudinal inclination angle;

whereby the adjustable roof curb device is configured to be adjustable for mounting on a pitched surface of a roof, such that the longitudinal inclination angle is equal to a roof pitch angle of the roof, such that the top surface of the top curb component is adjustable to be level;

such that the roof-mountable appliance is mounted level on the top curb component.

2. The adjustable roof curb system of claim 1, wherein the adjustable roof curb device further comprises:

a plurality of locking screws;

such that the top curb component is secured in position with the locking screws screwed through sides of the top curb component and the base curb component.

3. The adjustable roof curb system of claim 1, wherein the right pivot pin and the left pivot pin are configured to rest on right and left upper edges of the base curb component, respectively, during adjustment of the longitudinal inclination angle.

4. The adjustable roof curb system of claim 1, wherein:

the right side of the base curb component comprises a right pivot aperture; and the left side of the base curb component comprises a left pivot aperture;

such that the right pivot pin protrudes through the right pivot aperture and the left pivot pin protrudes through the left pivot aperture.

5. The adjustable roof curb system of claim 1, wherein a lateral pivot axis of the adjustable roof curb device is positioned in a front portion of the top curb component, such that a front longitudinal top plan length of the top curb component, between a front upper edge of the top curb component and a top plan longitudinal position of the lateral pivot axis between the left pivot pin and the right pivot pin, is in a range of 10-30 percent of a total longitudinal top plan length of the top curb component, between the front upper edge of the top curb component and a rear upper edge of the top curb component.

6. The adjustable roof curb system of claim 1, wherein a top front angle between a top front side and a top upper edge of the top curb component is larger than a bottom front angle between a bottom front side and a bottom upper edge of the base curb component, to enable pivoting of the top curb component relative to the base curb component while ensuring water sealing of the adjustable roof curb device.

7. The adjustable roof curb system of claim 6, wherein the top front angle is 90 degrees and the bottom front angle is in a range of 65 to 85 degrees.

8. The adjustable roof curb system of claim 1, wherein a front side of the base curb component is configured as a lateral downward-angled v-shaped canal, wherein the lateral downward-angled v-shaped canal comprises:

a) an upper front portion; and b) a lower front portion;

wherein the upper front portion is connected to the lower front portion along a lateral direction, such that a canal angle between the upper front portion and the lower front portion is less than 180 degrees; and such that a first end of the lateral downward-angled v-shaped canal is positioned higher than a second end of the lateral downward-angled v-shaped canal, when the adjustable roof curb device is positioned level on the roof, such that the lateral downward-angled v-shaped canal is configured to guide a flow of rainwater from the first end to the second end.

9. The adjustable roof curb system of claim 8, wherein the upper front portion is configured to be widening from the first end to the second end and the lower front portion is configured to be narrowing from the first end to the second end, such that the lateral downward-angled v-shaped canal guides the rainwater to exit the lateral downward-angled v-shaped canal closer to the pitched surface of the roof.

10. The adjustable roof curb system of claim 1, further comprising:

a) at least two first s-brackets, such that an inner portion of each of the at least two first s-brackets is configured to hang from an upper edge of a first side of the top curb component; and b) at least two second s-brackets, such that an inner portion of each of the at least two second s-brackets is configured to hang from an upper edge of an opposing second side of the top curb component;

such that a lower portion of the roof-mountable appliance is configured to be mounted on outer portions of the at least two first s-brackets and the at least two second s-brackets.

11. An adjustable roof curb system, comprising:

an adjustable roof curb device, comprising:

a top curb component; and a base curb component;

wherein the top curb component is configured to slide over the base curb component, such that a longitudinal inclination angle, between a top surface of the top curb component and a bottom surface of the base curb component, is adjustable by pivoting of the top curb component relative to the base curb component;

wherein the top curb component further comprises:

a top curb body;

a right pivot pin mounted on an inner right surface of a front upper part of a right side of the top curb body; and a left pivot pin mounted on an inner right surface of a front upper part of a left side of the top curb body;

such that the right pivot pin and the left pivot pin are configured to contact with a right side and a left side of the base curb component, respectively, to function as pivot points during adjustment of the longitudinal inclination angle;

whereby the adjustable roof curb device is configured to be adjustable for mounting on a pitched surface of a roof, such that the longitudinal inclination angle is equal to a roof pitch angle of the roof, such that the top surface of the top curb component is adjustable to be level.

12. The adjustable roof curb system of claim 11, wherein the right pivot pin and the left pivot pin are configured to rest on right and left upper edges of the base curb component, respectively, during adjustment of the longitudinal inclination angle.

13. The adjustable roof curb system of claim 11, wherein:

the right side of the base curb component comprises a right pivot aperture; and the left side of the base curb component comprises a left pivot aperture;

such that the right pivot pin protrudes through the right pivot aperture and the left pivot pin protrudes through the left pivot aperture.

14. The adjustable roof curb system of claim 11, wherein a lateral pivot axis of the adjustable roof curb device is positioned in a front portion of the top curb component, such that a front longitudinal top plan length of the top curb component, between a front upper edge of the top curb component and a top plan longitudinal position of the lateral pivot axis between the left pivot pin and the right pivot pin, is in a range of 10-30 percent of a total longitudinal top plan length of the top curb component, between the front upper edge of the top curb component and a rear upper edge of the top curb component.

15. The adjustable roof curb system of claim 11, wherein a top front angle between a top front side and a top upper edge of the top curb component is larger than a bottom front angle between a bottom front side and a bottom upper edge of the base curb component, to enable pivoting of the top curb component relative to the base curb component while ensuring water sealing of the adjustable roof curb device.

16. The adjustable roof curb system of claim 15, wherein the top front angle is 90 degrees and the bottom front angle is in a range of 65 to 85 degrees.

17. The adjustable roof curb system of claim 11, wherein a front side of the base curb component is configured as a lateral downward-angled v-shaped canal, wherein the lateral downward-angled v-shaped canal comprises:

a) an upper front portion; and b) a lower front portion;

wherein the upper front portion is connected to the lower front portion along a lateral direction, such that a canal angle between the upper front portion and the lower front portion is less than 180 degrees; and such that a first end of the lateral downward-angled v-shaped canal is positioned higher than a second end of the lateral downward-angled v-shaped canal, when the adjustable roof curb device is positioned level on the roof, such that the lateral downward-angled v-shaped canal is configured to guide a flow of rainwater from the first end to the second end.

18. The adjustable roof curb system of claim 17, wherein the upper front portion is configured to be widening from the first end to the second end and the lower front portion is configured to be narrowing from the first end to the second end, such that the lateral downward-angled v-shaped canal guides the rainwater to exit the lateral downward-angled v-shaped canal closer to the pitched surface of the roof.

19. An adjustable roof curb system, comprising:

a) a roof-mountable appliance; and b) an adjustable roof curb device, comprising:

a top curb component;

a base curb component;

at least two first s-brackets, such that an inner portion of each of the at least two first s-brackets is configured to hang from an upper edge of a first side of the top curb component; and at least two second s-brackets, such that an inner portion of each of the at least two second s-brackets is configured to hang from an upper edge of an opposing second side of the top curb component;

such that a lower portion of the roof-mountable appliance is configured to be mounted on outer portions of the at least two first s-brackets and the at least two second s-brackets;

wherein the top curb component is configured to slide over the base curb component, such that a longitudinal inclination angle, between a top surface of the top curb component and a bottom surface of the base curb component, is adjustable by pivoting of the top curb component relative to the base curb component;

whereby the adjustable roof curb device is configured to be adjustable for mounting on a pitched surface of a roof, such that the longitudinal inclination angle is equal to a roof pitch angle of the roof, such that the top surface of the top curb component is adjustable to be level;

such that the roof-mountable appliance is mounted level on the top curb component.

20. An adjustable roof curb system, comprising:

an adjustable roof curb device, comprising:

a top curb component; and a base curb component;

wherein the top curb component is configured to slide over the base curb component, such that a longitudinal inclination angle, between a top surface of the top curb component and a bottom surface of the base curb component, is adjustable by pivoting of the top curb component relative to the base curb component; and wherein a top front angle between a top front side and a top upper edge of the top curb component is larger than a bottom front angle between a bottom front side and a bottom upper edge of the base curb component, to enable pivoting of the top curb component relative to the base curb component while ensuring water sealing of the adjustable roof curb device;

whereby the adjustable roof curb device is configured to be adjustable for mounting on a pitched surface of a roof, such that the longitudinal inclination angle is equal to a roof pitch angle of the roof, such that the top surface of the top curb component is adjustable to be level.

21. An adjustable roof curb system, comprising:

an adjustable roof curb device, comprising:

a top curb component; and a base curb component;

wherein the top curb component is configured to slide over the base curb component, such that a longitudinal inclination angle, between a top surface of the top curb component and a bottom surface of the base curb component, is adjustable by pivoting of the top curb component relative to the base curb component;

wherein a front side of the base curb component is configured as a lateral downward-angled v-shaped canal, wherein the lateral downward-angled v-shaped canal comprises:

an upper front portion; and a lower front portion;

wherein the upper front portion is connected to the lower front portion along a lateral direction, such that a canal angle between the upper front portion and the lower front portion is less than 180 degrees; and such that a first end of the lateral downward-angled v-shaped canal is positioned higher than a second end of the lateral downward-angled v-shaped canal, when the adjustable roof curb device is positioned level on the roof, such that the lateral downward-angled v-shaped canal is configured to guide a flow of rainwater from the first end to the second end;

whereby the adjustable roof curb device is configured to be adjustable for mounting on a pitched surface of a roof, such that the longitudinal inclination angle is equal to a roof pitch angle of the roof, such that the top surface of the top curb component is adjustable to be level.

* * * * *